US009025994B2

(12) United States Patent
Yamashita et al.

(10) Patent No.: US 9,025,994 B2
(45) Date of Patent: May 5, 2015

(54) IMAGE FORMING APPARATUS

(71) Applicants: Takeshi Yamashita, Osaka (JP); Yoshie Iwakura, Osaka (JP); Yasuhiro Fujiwara, Oaska (JP)

(72) Inventors: Takeshi Yamashita, Osaka (JP); Yoshie Iwakura, Osaka (JP); Yasuhiro Fujiwara, Oaska (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/086,483

(22) Filed: Nov. 21, 2013

(65) Prior Publication Data

US 2014/0153955 A1 Jun. 5, 2014

(30) Foreign Application Priority Data

Nov. 30, 2012 (JP) ..... 2012-263445
Jun. 6, 2013 (JP) ..... 2013-119683

(51) Int. Cl.
*G03G 15/16* (2006.01)
*G03G 15/01* (2006.01)

(52) U.S. Cl.
CPC ..... *G03G 15/0189* (2013.01); *G03G 15/1605* (2013.01); *G03G 15/168* (2013.01)

(58) Field of Classification Search
CPC ..... G03G 15/168
USPC ..... 399/101
See application file for complete search history.

(56) References Cited

U.S. PATENT DOCUMENTS

2003/0235416 A1* 12/2003 Mochizuki et al. ..... 399/27
2006/0210326 A1 9/2006 Takehara et al.
2006/0210327 A1 9/2006 Iwakura et al.
2006/0245782 A1* 11/2006 Hirai et al. ..... 399/101
2006/0257176 A1 11/2006 Kawasaki et al.
2008/0069605 A1 3/2008 Fuwa et al.
2008/0131162 A1 6/2008 Nakatake et al.
2008/0152378 A1 6/2008 Yamashita et al.
2008/0226313 A1 9/2008 Tsuchida et al.
2008/0310893 A1 12/2008 Adachi et al.
2009/0014288 A1 1/2009 Miyazaki et al.
2009/0016772 A1 1/2009 Adachi et al.
2009/0060540 A1 3/2009 Matsushita et al.
2009/0180791 A1 7/2009 Matsushita et al.
2009/0279909 A1 11/2009 Matsushita et al.

(Continued)

FOREIGN PATENT DOCUMENTS

JP 10-048945 2/1998
JP 2000-132028 5/2000

*Primary Examiner* — David Gray
*Assistant Examiner* — Thomas Giampaolo, II
(74) *Attorney, Agent, or Firm* — Oblon, McClelland, Maier & Neustadt, L.L.P.

(57) ABSTRACT

An image forming apparatus includes an image bearing member to bear a latent image on a surface thereof, a developing device to develop the latent image with toner, an intermediate transfer member, a secondary transfer member, a cleaning device, and a main body. The cleaning device cleans the secondary transfer member for a predetermined time period T1 during a startup operation after printing is completed normally before subsequent printing. The main body houses the image bearing member, the developing device, the intermediate transfer member, the secondary transfer member, and the cleaning device. At least one of the image bearing member and the developing device constitutes a process cartridge detachably attachable relative to the main body, and in a case in which the process cartridge is installed in the main body, the cleaning device cleans the secondary transfer member for a time period T2 extended from the predetermined time period T1.

9 Claims, 6 Drawing Sheets

(56) References Cited

U.S. PATENT DOCUMENTS

| | | | |
|---|---|---|---|
| 2009/0324270 | A1 | 12/2009 | Yamashita et al. |
| 2010/0239334 | A1 | 9/2010 | Iwami et al. |
| 2011/0026943 | A1 | 2/2011 | Konishi et al. |
| 2013/0195487 | A1 | 8/2013 | Yamashita et al. |
| 2013/0266332 | A1 | 10/2013 | Miyazaki et al. |

* cited by examiner

FIG. 6

| | INSTALLED PROCESS UNIT DISTANCE TRAVELLED L [m] | OTHER PROCESS UNITS DISTANCE TRAVELLED [m] | EXTENSION OF TIME OF SECONDARY TRANSFER CLEANING | | | CONTAMINATION OF BACK SURFACE |
|---|---|---|---|---|---|---|
| EMBODIMENT 1 | L < 1000 | L < 1000 | 0 | — | — | ○ : GOOD |
| EMBODIMENT 2 | L < 3000 | L < 3000 | 0 | — | — | ○ : GOOD |
| COMPARATIVE EXAMPLE 1 | 3000 ≤ L | 3000 ≤ L | — | 0 | — | × : POOR |
| COMPARATIVE EXAMPLE 2 | 3000 ≤ L | 3000 ≤ L | — | 5 | — | × : POOR |
| COMPARATIVE EXAMPLE 3 | 3000 ≤ L | 3000 ≤ L | — | 10 | — | △ : FAIR |
| EMBODIMENT 3 | 3000 ≤ L | 3000 ≤ L | — | 15 | — | ○ : GOOD |
| COMPARATIVE EXAMPLE 4 | L < 3000 | 3000 ≤ L | — | — | 0 | × : POOR |
| COMPARATIVE EXAMPLE 5 | L < 3000 | 3000 ≤ L | — | — | 5 | △ : FAIR |
| EMBODIMENT 4 | L < 3000 | 3000 ≤ L | — | — | 10 | ○ : GOOD |

IMAGE FORMING APPARATUS

CROSS-REFERENCE TO RELATED APPLICATIONS

This patent application is based on and claims priority pursuant to 35 U.S.C. §119 from Japanese Patent Application Nos. 2012-263445, filed on Nov. 30, 2012, and 2013-119683, filed on Jun. 6, 2013, both in the Japan Patent Office, which are hereby incorporated herein by reference in their entirety.

BACKGROUND

1. Technical Field

Exemplary aspects of the present disclosure generally relate to an image forming apparatus, such as a copier, a facsimile machine, a printer, or a multi-functional system including a combination thereof, and more particularly to, an image forming apparatus including a cleaning device for cleaning a secondary transfer device.

2. Description of the Related Art

In known electrophotographic image forming apparatuses, a photosensitive member, a developing device, a cleaning device for cleaning the photosensitive member, and so forth are assembled as a single unit, known as a process cartridge, and the process cartridge is detached from and attached to a main body of the image forming apparatus in the case of paper jams and during maintenance.

In such a process cartridge, toner tends to leak easily from an area in which toner moves, such as between a developing roller of the developing device and the photosensitive member, and between a cleaning blade of the cleaning device and the photosensitive member. In order to prevent the leakage of toner, in general, a seal member is provided to the area in which toner moves. In order to enhance sealing capabilities, a known approach includes two sets of seal members. Such a configuration is proposed, for example, in JP-2000-132028-A.

In another approach, an amount of contact of the seal member relative to the photosensitive member is made adjustable. Such a configuration is proposed, for example, in JP-H10-48945.

After extended use, in the process cartridge, degradation of the seal member and a part that contacts the seal member, or an accumulation of toner on the seal member reduces the sealing capabilities of the seal member. As a result, toner leaks undesirably from the sealed portion in the process cartridge upon attachment and detachment of the process cartridge relative to the main body of the image forming apparatus.

Such leakage of toner contaminates an intermediate transfer belt with the toner. The toner adhered to the intermediate transfer belt moves to a secondary transfer roller in the subsequent imaging process, contaminating the secondary transfer roller and then a rear surface of the recording medium. In order to prevent such difficulty, the known sealing reinforcements as described above may be employed. However, the know approaches require an increase in the number of parts and complicate an overall configuration, thereby increasing the cost.

In recent years, in order to accommodate growing market demand for better image quality, the diameter of toner particles is reduced, and a degree of sphericity is increased. The fluidity of toner of this kind is enhanced as compared with standard toner. Thus, leakage of such toner is difficult to prevent with the known seal members upon detachment and attachment of the process cartridge, resulting in the contamination of a recording medium.

In view of the above, there is thus an unsolved need for an image forming apparatus capable of preventing contamination of a recording medium with toner upon detachment and attachment of the process cartridge.

SUMMARY

In view of the foregoing, in an aspect of this disclosure, there is provided an improved image forming apparatus including an image bearing member, a developing device, an intermediate transfer member, a secondary transfer member, a cleaning device, and a main body. The image bearing member bears a latent image on a surface thereof. The developing device supplies toner to the latent image bearing member to develop the latent image into a toner image. The intermediate transfer member is disposed opposite the image bearing member and forms a primary transfer nip therebetween to transfer primarily the toner image borne on the image bearing member onto the intermediate transfer member. The secondary transfer member is disposed opposite the image bearing member and forms a secondary transfer nip therebetween to transfer secondarily the toner image borne on the intermediate transfer member onto a recording medium. The cleaning device cleans the secondary transfer member for a predetermined time period T1 during a startup operation after printing is completed normally before subsequent printing. The main body houses the image bearing member, the developing device, the intermediate transfer member, the secondary transfer member, and the cleaning device. At least one of the image bearing member and the developing device constitutes a process cartridge detachably attachable relative to the main body, and in a case in which the process cartridge is installed in the main body, the cleaning device cleans the secondary transfer member for a time period T2 extended from the predetermined time period T1.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 6 is a table showing an evaluation of contamination of recording media when the extension of time for the secondary-transfer cleaning is changed;

DETAILED DESCRIPTION

Figure 1:
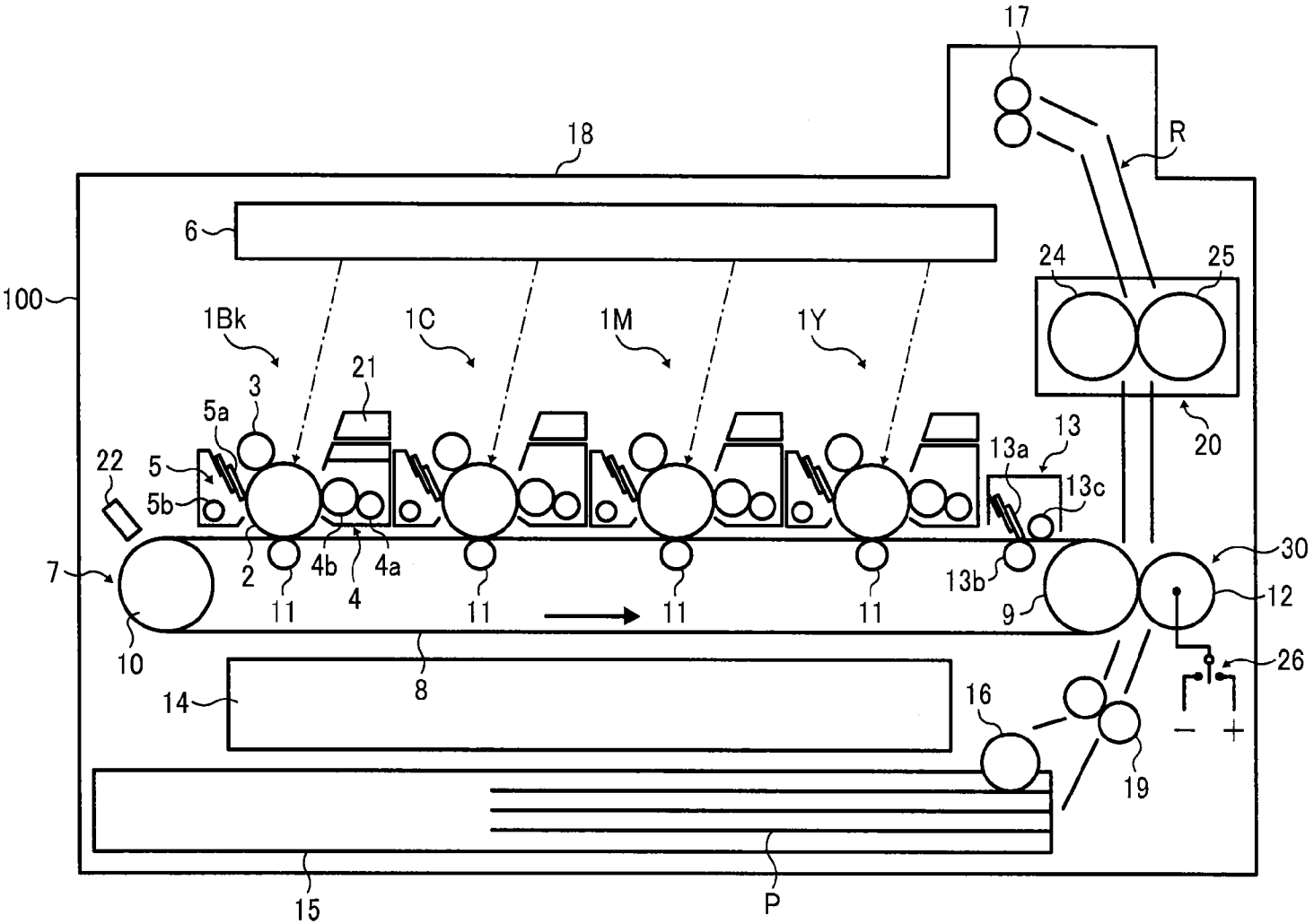
FIG. 1 is a schematic diagram illustrating a printer as an example of the image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

Referring now to FIG. 1, there is provided a schematic diagram illustrating a printer as an example of an image forming apparatus according to an illustrative embodiment of the present disclosure. With reference to FIG. 1, a description is provided of an overall structure and operation of the image forming apparatus.

As illustrated in FIG. 1, a main body 100 of the image forming apparatus includes four process cartridges 1Y, 1M, 1C, and 1Bk, one for each of primary colors yellow, magenta, cyan, and black, arranged in tandem substantially at the center of the main body 100 and facing a transfer unit 7. Each of process cartridges 1Y, 1M, 1C, and 1Bk includes a photosensitive member 2 serving as an image bearing member for bearing an electrostatic latent image on the surface thereof, a charging roller 3 serving as a charger, a developing device 4, a cleaning device 5, and so forth. The charging roller 3 charges the surface of the photosensitive member 2. The developing device 4 supplies toner to the photosensitive drum 2 and develops the electrostatic latent image on the photosensitive drum 2 with toner. The cleaning device 5 cleans the surface of the photosensitive member 2.

It is to be noted that the suffixes Y, M, C, and Bk denote colors yellow, magenta, cyan, and black, respectively, and to simplify the description, these suffixes are omitted herein unless otherwise specified. The process cartridges 1Y, 1M, 1C, and 1Bk all have the same configuration, differing only in the color of toner employed. Thus, the suffix indicating the color is provided to the process cartridge 1Bk of black color. The description is provided of the process cartridge 1Bk for forming a black image as an example of the process cartridges. The suffixes indicating other colors are omitted in FIG. 1.

The developing device 4 includes a supply roller 4*a* and a developing roller 4*b*. Toner delivered from a toner supply unit 21 disposed above the developing device 4 to the developing device 4 is supplied to the surface of the photosensitive member 2 as the supply roller 4*a* and the developing roller 4*b* rotate. Preferably, the toner to be used is polymerized toner having a small diameter less than or equal to 6 μm and high sphericity.

The cleaning device 5 for cleaning the surface of the photosensitive member 2 includes a cleaning blade 5*a* and a toner conveyor 5*b*. The cleaning blade 5*a* of the cleaning device 5 contacts the surface of the photosensitive member 2 at a certain angle such that the leading edge of the cleaning blade 5*a* faces counter to the direction of rotation of the photosensitive member 2. The toner conveyor 5*b* transports toner removed by the cleaning blade 5*a* from the photosensitive member 2.

In FIG. 1, an exposure device 6 is disposed above the process cartridges 1Y, 1M, 1C, and 1Bk. The exposure device 6 forms an electrostatic latent image on each of the surfaces of the photosensitive members 2. According to the present illustrative embodiment, the exposure device 6 includes a light source, a polygon mirror, an f-θ lens, a reflective mirror, and so forth, and illuminates the surfaces of the photosensitive members 2 with laser light based on image data. Alternatively, the exposure device 6 may employ an LED array.

The transfer device 7 to transfer a toner image onto a recording medium is disposed below the process cartridges 1Y, 1M, 1C, and 1Bk. The transfer device 7 includes an intermediate transfer belt 8 formed into an endless loop. The intermediate transfer belt 8 is formed into an loop and entrained around a plurality of rollers, i.e., a drive roller 9, a driven roller 10, and primary transfer rollers 11. The drive roller 9 rotates in the counterclockwise direction in FIG. 1, causing the intermediate transfer belt 8 to rotate in the direction indicated by an arrow. According to the present illustrative embodiment, the drive roller 9 serves as a opposing roller facing a secondary transfer roller 12 via the intermediate transfer belt 8, thereby forming a secondary transfer nip.

Four primary transfer rollers 11 are disposed inside the looped intermediate transfer belt 8, each facing the photosensitive member 2. The primary transfer rollers 11 press against the inner circumferential surface of the intermediate transfer belt 8. A primary transfer nip is formed at a place of contact at which the intermediate transfer belt 8 pressed by the primary transfer rollers 11 contacts the photosensitive members 2. Each of the primary transfer rollers 11 is connected to a power source and supplied with a predetermined direct current (DC) voltage and/or an alternating current (AC) voltage.

According to the present illustrative embodiment, as a primary transfer device, a metal roller is employed. Alternatively, a conductive blade and a conductive sponge roller, or the like may be employed.

The secondary transfer roller 12 serving as a secondary transfer member is disposed opposite the drive roller 9 via the intermediate transfer belt 8. The secondary transfer roller 12 presses against the outer circumferential surface of the intermediate transfer belt 8, thereby forming the secondary transfer nip at the place of contact at which the secondary transfer roller 12 contacts the intermediate transfer belt 8. Similar to the primary transfer rollers 11, the transfer roller 12 is connected to a power source and supplied with a predetermined direct current (DC) voltage and/or an alternating current (AC) voltage.

The secondary transfer roller 12 comprises a metal cored bar covered with a conductive elastic layer made of a conductive material. As a secondary transfer roller, for example, a conductive roller and an electron-conductive type roller, or the like may be employed. Preferably, the secondary transfer roller 12 is always in contact with the intermediate transfer belt 8, thereby saving the cost as compared with making the secondary transfer roller 12 separable from the intermediate transfer belt 8.

A belt cleaning device 13 is disposed upstream from the process cartridge 1Y, but downstream from the secondary transfer nip in the direction of rotation of the intermediate transfer belt. The process cartridge 1Y is disposed at the extreme upstream end in the direction of rotation of the intermediate transfer belt 8. The belt cleaning device 13 cleans the intermediate transfer belt 8. More specifically, the belt cleaning device 13 removes residual toner remaining on the surface of the intermediate transfer belt 8 after secondary transfer. According to the present illustrative embodiment, the belt cleaning device 13 includes a cleaning blade 13*a*, an opposed roller 13*b*, and a conveyor 13*c*. The cleaning blade 13*a* contacts the intermediate transfer belt 8 at a certain angle facing the direction of rotation of the intermediate transfer belt 8. The opposed roller 13*b* is made of metal and faces the cleaning blade 13*a* via the intermediate transfer belt 8. The conveyor 13*c* is made of a coil or the like.

A toner detector 22 is disposed substantially near the downstream side of the intermediate transfer belt 8 in the direction of rotation of the intermediate transfer belt 8. According to the present illustrative embodiment shown in FIG. 1, the toner detector 22 is disposed downstream from the process cartridge 1Bk which is located at the extreme downstream end in the direction of rotation of the intermediate transfer belt 8. The toner detector 22 faces the driven roller 10 via the intermediate transfer belt 8. The toner detector 22 detects and measures an amount of toner transferred and adhered to the intermediate transfer belt 8. Furthermore, the detector 22 employs a combination of a specular reflection method and a diffuse reflection method to measure the position of toner images of each color. Based on information provided by the toner detector 22, the density and the position of an image, and so forth are adjusted.

A toner collecting bin 14 is disposed below the transfer device 7. The toner collecting bin 14 stores waste toner delivered by the toner conveyor 5*b* of the cleaning device 5 and the toner conveyor 13*c* of the belt cleaning device 13.

A sheet tray 15 storing a stack of recording media P, a sheet feed roller 16, and so forth are disposed substantially at the bottom of the image forming apparatus main body 100. The recording medium P includes, but is not limited to, thick paper, postcards, envelopes, normal or standard paper, thin paper, coated paper such as coated paper and art paper, and tracing paper. As a recording medium P, an OHP sheet and an OHP film may be used as well.

A pair of sheet output rollers 17 is disposed substantially at the upper portion of the main body 100. The pair of the sheet output rollers 17 outputs the recording medium P to the outside. Multiple recording media discharged outside can be stacked on a sheet output tray 18 disposed at the upper portion of the main body 100.

In the main body 100 of the image forming apparatus, the recording medium P fed from the sheet tray 15 is delivered to the sheet output tray 18 via the secondary transfer nip along a sheet path R. Upstream from the secondary transfer roller 12 in the sheet path R in the direction of sheet delivery, there is provided a pair of registration rollers 19 serving as timing rollers that delivers the recording medium to the secondary transfer nip at appropriate timing. Downstream from the secondary transfer roller 12 in the direction of sheet delivery is a fixing device 20 to fix an unfixed toner image transferred on the recording medium P. The fixing device 20 includes a fixing roller 24 including a heat source and a pressing roller 25 that presses against the fixing roller 24. A place of contact, a so-called fixing nip, at which the fixing roller 24 and the pressing roller 25 contact, is formed.

With reference to FIG. 1, a description is provided of basic operation of the image forming apparatus according to an illustrative embodiment of the present disclosure.

As printing operation is initiated, each of the photosensitive members 2 of the process cartridges 1Y, 1M, 1C, and 1Bk is rotatably driven by a driving unit. While rotating, the surface of each of the photosensitive members 2 is charged uniformly to a predetermined polarity by the charging roller 3. Subsequently, based on image information of a document read by an image reading device, the charged surfaces of the photosensitive drums 2 are illuminated with laser light projected from the exposure device 6. Accordingly, electrostatic latent images are formed on the surfaces of the photosensitive drums 2.

More specifically, upon exposure of the photosensitive members 2, the image information is separated into individual color components, i.e., yellow, magenta, cyan, and black, and laser light based on the single color information thus obtained illuminates the photosensitive members 2. The electrostatic latent images on the photosensitive members 2 are developed with respective color of toner by the developing devices 4 into visible images, known as toner images.

Upon start of printing operation, the intermediate transfer belt 8 is driven to rotate in the direction of arrow in FIG. 1, and the primary transfer rollers 11 are supplied with a constant voltage having a polarity opposite that of the charged toner or a voltage under constant current control, thereby forming a transfer electric field in the primary transfer nips defined by the intermediate transfer belt surface and the photosensitive drums 2.

Subsequently, as the toner images on the photosensitive drums 2 arrive at the primary transfer nips along with the rotation of the photosensitive drums 2, the transfer electric field generated in the primary transfer nips causes the toner images on the photosensitive members 2 to transfer to the intermediate transfer belt 8 such that they are superimposed one atop the other, thereby forming a composite toner image on the surface of the intermediate transfer belt 8. Residual toner, not having been transferred onto the intermediate transfer belt 8, thus remaining on the photosensitive drums 2 is removed by the cleaning blade 5*a* of the belt cleaning device 5. The removed toner is transported to the toner collecting bin 14. Subsequently, residual charge remaining on the surface of the photosensitive members 2 is removed, and the surface potential thereof is initialized by a charge remover in preparation for the subsequent imaging cycle.

In the meantime, the sheet feed roller 16 starts to rotate, picking up a top sheet of the stack of recording media P from the sheet tray 15 and feeding it to the sheet path R. The recording medium P fed to the sheet path R is sent to the secondary transfer nip by the pair of registration rollers 19 at appropriate timing. At this time, the secondary transfer roller 12 is supplied with the transfer voltage having a polarity opposite that of the charged toner of the toner image on the intermediate transfer belt 8, thus forming a transfer electric field at the secondary transfer nip.

Subsequently, as the toner image on the intermediate transfer belt 8 arrives at the secondary transfer nip along with the rotation of the intermediate transfer belt 8, the transfer electric field generated in the secondary transfer nip causes the toner image on the intermediate transfer belt 8 to transfer to the recording medium P. Residual toner, not having been transferred onto the recording medium P, thus remaining on the intermediate transfer belt 8 is removed by the cleaning blade 13*a* of the belt cleaning device 13. The removed toner is transported to the toner collecting bin 14.

Subsequently, the recording medium P is delivered to the fixing device 20. In the fixing device 20, the toner image is fixed on the recording medium P as the recording medium P passes through the fixing nip between the fixing roller 4 and the pressing roller 25 where heat and pressure are applied. After the toner image is fixed on the recording medium P, the recording medium P is output onto the sheet output tray 18 by the sheet output roller 17.

The above description pertains to image forming operation for forming a multiple-color image on a recording medium. However, the image forming operation is not limited thereto. The image forming apparatus may form a single-color image using one of process cartridges 1Y, 1M, 1C, and 1Bk, or two or three-color image using two or three process cartridges.

Figure 2:
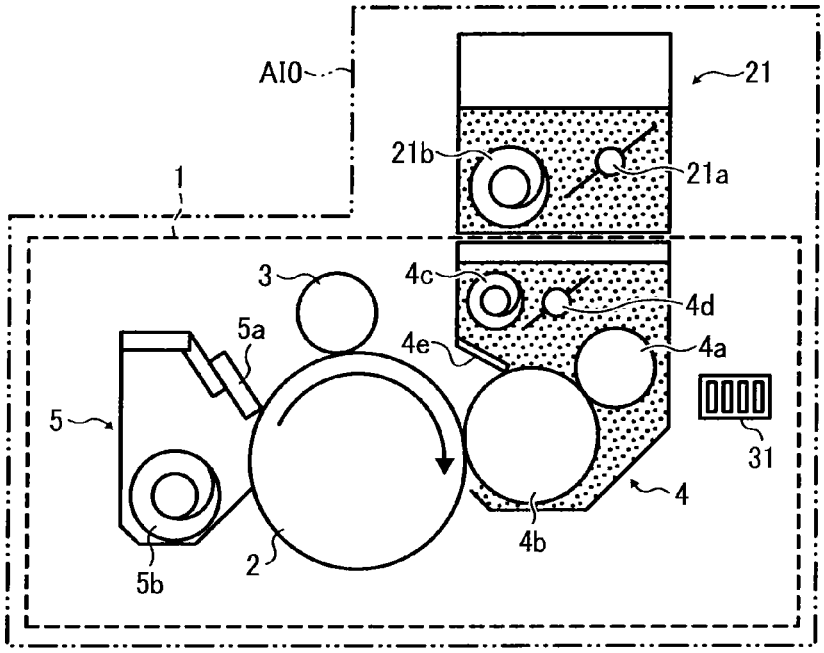
FIG. 2 is a cross-sectional view schematically illustrating a process cartridge and a toner supply container according to an illustrative embodiment of the present disclosure.

With reference to FIG. 2, a description is provided of a toner supply unit 21 and the developing device 4. FIG. 2 is a cross-sectional view schematically illustrating one of the process cartridges 1Y, 1M, 1C, and 1Bk, the toner supply unit 21, and the developing device 4 according to an illustrative embodiment of the present disclosure. It is to be noted that the process cartridge 1Y, 1M, 1C, and 1Bk all have the same configuration, differing only in the color of toner employed. Thus, the suffixes indicating the color are omitted herein.

The toner supply unit 21 constitutes, for example, a toner cartridge. The toner supply unit 21 is detachably attachable relative to the main body 100 of the image forming apparatus, independent of the process cartridge 1. The toner supply unit 21 includes a mixing paddle 21*a* and a transport member 21*b* inside the toner supply unit 21. The mixing paddle 21*a* is a mixing member that mixes the toner. The transport member 21*b* includes, but is not limited to a screw and a coil. The toner supply unit 21 includes a toner supply opening connected to a space inside the developing device 4 when installed in the image forming apparatus main body 100. The toner stored in the toner supply unit 21 is mixed by the mixing paddle 21*a* to keep its fluidity. The toner is delivered to the above-described toner supply opening as the transport member 21*b* rotates and is supplied to the developing device 4 from the toner supply opening.

The transport member 21*b* is connected to a drive source disposed inside the main body 100. The transport member 21*b* is connected to and disconnected from the drive source by a known switching device such as a clutch. The amount of toner supply can be adjusted by a driving time of the drive source. The driving time of the drive source is controlled in accordance with, for example, a change in the fluidity of toner (changes in the color of toner, and temperature and humidity).

In addition to the supply roller 4*a* and the developing roller 4*b*, the developing device 4 includes a transport member 4*c*, an agitator 4*d*, and a blade 4*e*. A power source is connected to the supply roller 4*a*, the developing roller 4*b*, and the blade 4*e* to supply a predetermined voltage thereto. Inside the developing device 4, the toner is mixed by the agitator 4*d* and delivered to an entire area in the longitudinal direction by the transport member 4*c*. The supply roller 4*a* is formed of a sponge material and rotated. As the supply roller 4*a* rotates, the toner is delivered to the developing roller 4*b* serving as a toner bearing member. As the developing roller 4*b* rotates, the toner is supplied to the surface of the photosensitive member 2. The thickness of the toner delivered from the supply roller 4*a* to the developing roller 4*b* is adjusted evenly by the blade 4*e* so that the thickness of the toner on the developing roller 4*b* is uniform. Then, the toner is supplied to the photosensitive member 2.

The process cartridge 1 described above includes, for example, the photosensitive member 2, the charging roller 3, the developing device 4, and the cleaning device 5 as a single integrated unit as indicated by a broken line in FIG. 2. The process cartridge 1 is detachably attachable relative to the main body 100, thereby allowing the photosensitive member 2, the charging roller 3, the developing device 4, and the cleaning device 5 to be detachably attachable relative to the main body 100. According to the present illustrative embodiment described above, the toner supply unit 21 and the developing device 4 are disposed in proximity to each other, and the toner supply unit 21 directly supplies the toner to the developing device 4. Alternatively, the toner supply unit 21 may be disposed apart from the developing device 4 and supply toner to the developing device 4 via a supply path from the toner supply unit 21.

A storage element 31 such as an IC chip is attached to the process cartridge 1 to store product information, history of use, and so forth. The main body 100 includes a reading device to read the information stored in the storage element 31. The reading device is disposed near or at the installation position of each of the process cartridges 1. Installation of the process cartridge 1 in the main body 100 can be recognized by the reading device which reads the information stored in the storage element 31. With this configuration, no additional detector for detecting installation and detachment of the process cartridge 1 relative to the main body 100 is needed, thereby reducing the cost.

In the process cartridge 1, a seal member contacts both ends of the developing roller 4*b* in order to prevent toner from leaking from the developing device 4. After extended use of the process cartridge 1, both ends of the developing roller 4*b* that contact the seal member are abraded. As the abrasion progresses, toner leaks from both ends of the developing device 4 due to impact generated upon installation and detachment of the process cartridge 1 relative to the main body 100. As a result, the leaked toner may drop on the intermediate transfer belt 8. The dropped toner on the intermediate transfer belt 8 moves to the secondary transfer roller 12 due to the subsequent printing, thereby contaminating a recording medium.

Toner leakage occurs also at a boundary between the photosensitive member 2 and the cleaning device 5 upon installation and detachment of the process cartridge 1.

In view of the above, according to the illustrative embodiment, the image forming apparatus includes a cleaning device 30 to clean the surface of the secondary transfer roller 12. The cleaning device 30 supplies the secondary transfer roller 12 with a voltage having the same polarity as that of the charged toner, thereby returning the toner once adhered to the secondary transfer roller 12 to the intermediate transfer belt 8 and hence cleaning the secondary transfer roller 12 in a process known as a secondary transfer cleaning.

As described above, the secondary transfer roller 12 is supplied with the transfer voltage having a polarity opposite that of the charged toner during printing. By contrast, during the secondary transfer cleaning, the voltage to be supplied to the secondary transfer roller 12 is inverted, thereby supplying the voltage having the same polarity as that of the charged toner to the secondary transfer roller 12. In order to invert the applied voltage, the cleaning device 30 includes a switching device 26 that switches a transmission line to the secondary transfer roller 12.

The secondary transfer cleaning by the cleaning device 30 is not performed during printing. The secondary transfer cleaning is performed at a time other than printing. That is, when the photosensitive member 2 and the intermediate transfer belt 8 need to be rotated at a time other than printing, the secondary transfer cleaning is performed.

More specifically, the cleaning device 30 performs the secondary transfer cleaning in the following cases:

1. when the main power is turned on until the image forming apparatus is in ready state;
2. When starting up from a sleep mode until the image forming apparatus is in ready state;
3. When starting up from a standby mode until the image forming apparatus is in ready state;
4. When starting up from recovery from paper jams until the image forming apparatus is in ready state; and
5. When starting up after forced shutdown until the image forming apparatus is in ready state.

When to perform the secondary transfer cleaning by the cleaning device 30 is not limited to these five cases described above. Regardless of the startup operation, the secondary transfer cleaning may be performed upon execution of an end sequence after completion of printing, upon adjustment of positions of toner images, upon adjustment of density, and/or upon color alignment. The duration of each secondary transfer cleaning is preset individually for each associating operation and event as a default time.

The term "startup" in the cases 2 through 5 herein refers to an operation that enables the image forming apparatus to become ready state. More specifically, the "startup" operation includes, but is not limited to, inputting an image signal from an external device, closing an exterior cover, and/or operation of the control panel. Turning the power ON in the case 1 itself corresponds to the startup operation.

In the case 2, the sleep mode refers to a state in which an image forming engine is OFF and only a minimum required controller is ON (power saving mode). The standby mode of case 3 refers to a state immediately after completion of printing, and the image forming engine and the controller are all ON. The "forced shutdown" of the case 5 refers to a case in which an illegal operation at a device such as an excessive temperature rise in the fixing device 20 is detected, hence forcing the printing operation to stop. The cases 1 through 3 assume a startup after the previous printing is finished normally. The cases 4 and 5 assume a startup after the previous printing is finished abnormally.

Figure 3A:
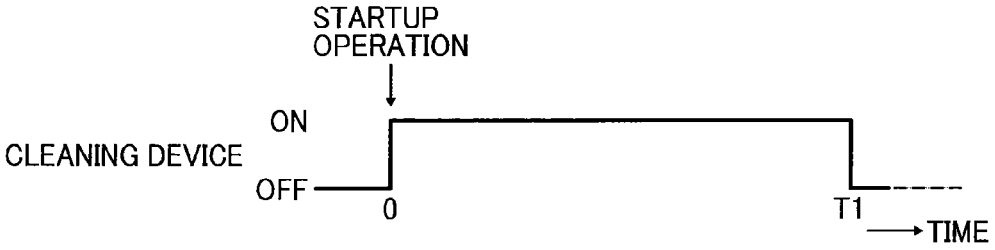
FIG. 3A is a timing chart showing a default cleaning time during which a secondary-transfer cleaning operation is performed as a default setting.
Figure 3B:
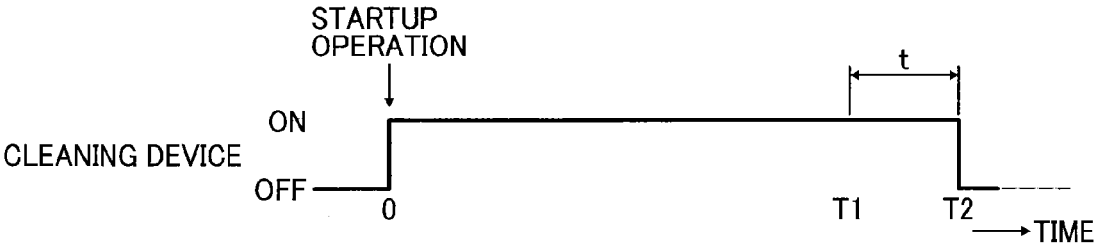
FIG. 3B is a timing chart showing an extension of time for the secondary-transfer cleaning operation upon installation of the process cartridge.

In view of the above, according to the present illustrative embodiment, when the startup operation is performed after the process cartridge 1 is installed in the main body 100 of the image forming apparatus, the cleaning device 30 performs the secondary transfer cleaning. A time T2 (shown in FIG. 3B) during which the secondary transfer cleaning is preformed is longer by a predetermined amount of time t than a predetermined time period T1 (shown in FIG. 3A) which is set as a default cleaning time corresponding to each of the startup operations in the cases of 1 through 3 for the startup after completion of normal printing (T2>T1). The time t is hereinafter referred to as an extension time.

In a case in which the default time during which the secondary transfer cleaning is performed is different between the startup operations in the cases 1) through 3), the extension time t is set such that the time T2 is longer than the longest time T1 among other time T1. The extension time t is set by a controller disposed in the image forming apparatus.

In known image forming apparatuses, when the process cartridge is installed in the image forming apparatus, the image forming apparatus recognizes the installation of the process cartridge as the main power being turned ON, and the secondary transfer cleaning is performed for a preset duration set as a default time corresponding to the startup operation in the case 1. By contrast, according to the illustrative embodiment of the present disclosure, when the process cartridge 1 is installed in the image forming apparatus, the duration of the secondary transfer cleaning is longer than the default time. During the secondary transfer cleaning, even when the toner is adhered to the surface of the intermediate transfer belt 8, the toner is prevented from getting transferred to the surface of the secondary transfer roller 12, and the toner on the intermediate transfer belt 8 having passed through the secondary transfer nip is collected and removed by the belt cleaning device 13. With this configuration, by the time the next printing starts, the intermediate transfer belt 8 and the secondary transfer roller 12 are cleaned, thereby preventing contamination of the recording medium P.

In recent years, there is increasing market demand for a short first print time. In order to accommodate such demand, a time from the startup operation after normal completion of printing in the cases 1 through 3 until the ready state tends to be shortened (approximately less than five seconds). Thus, similar to the known image forming apparatuses, even when the secondary transfer cleaning is performed for the prescribed or default time period associated with each startup operation after the startup operation in the cases of 1 through 3 is preformed, an adequate cleaning time cannot be secured, hence complicating efforts to prevent the contamination of the recording medium.

In view of the above, according to the illustrative embodiment of the present disclosure, only when the process cartridge 1 is installed in or removed from the main body 100, the time during which the secondary transfer cleaning is performed is extended. In this configuration, the time during which the secondary transfer cleaning is performed associated with the startup operation after normal completion of printing in the cases of 1 through 3 is the predetermined time set as the default time. Furthermore, in order to perform the above operation, no additional device is needed. Only changing the sequence can accommodate such operation. With this configuration, contamination of the recording medium P can be prevented at low cost while the first print time can be shortened.

In the startup operation after the previous printing is finished abnormally in the cases of 4 and 5, in general, a sequence for checking the system is carried out, which takes relatively long. In other words, it takes relatively long (for example, equal to or longer than 15 seconds) to be in the ready state from the startup operation. Therefore, the time set as a default time during which the secondary transfer cleaning is performed associated with the startup operation in the cases of 4 and 5 can be adequately long. With this configuration, in a case in which the process cartridge 1 is installed/removed after the previous printing is completed abnormally and then the secondary transfer cleaning is performed upon the startup operation, it is not necessary to extend the time to carry out the secondary transfer cleaning.

Figure 4:
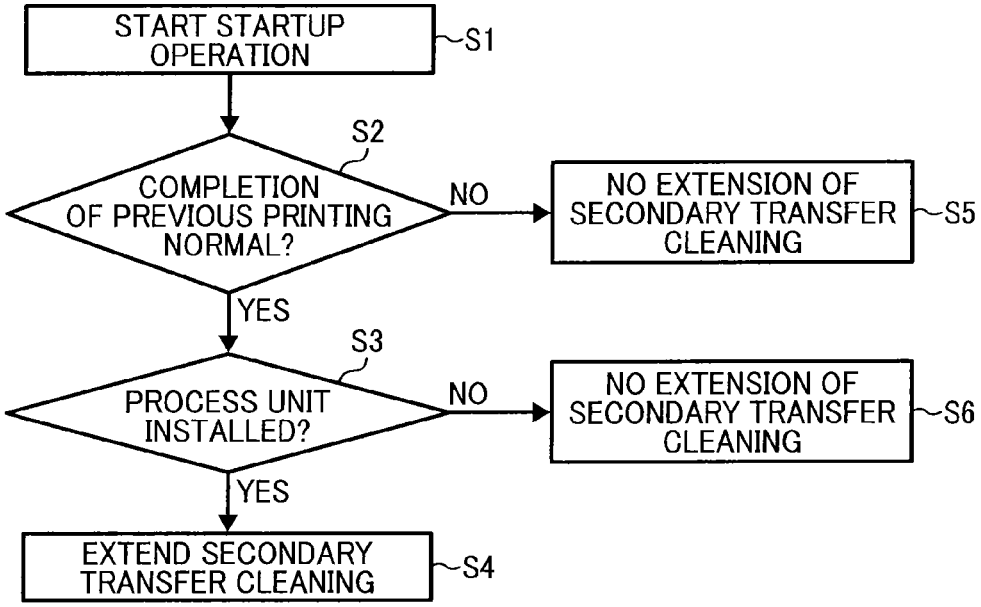
FIG. 4 is a flowchart showing steps of determination of time to carry out the secondary-transfer cleaning according to a first illustrative embodiment of the present disclosure.

With reference to FIG. 4, a description is provided of steps in a process of determination of the secondary transfer cleaning time according to a first illustrative embodiment of the present disclosure. FIG. 4 is a flowchart showing steps in a process of determination of the secondary transfer cleaning time.

As illustrated in FIG. 4, when the startup operation of the image forming apparatus is initialized at step S1, the controller of the image forming apparatus determines whether the previous printing is completed normally at step S2. If the previous printing is not completed normally (NO at step S2), the time during which the secondary transfer cleaning is performed is not extended. Instructed by the controller, the secondary transfer cleaning is performed for the predetermined time period preset as the default time period.

If the previous printing is completed normally (YES at step S2), whether the process cartridge 1 is installed in the main body 100 is determined by reading the information stored in the storage element 31 such as the IC chip by the reading device. In a case in which the process cartridge 1 is installed in the main body 100, the controller extends the time during which the secondary transfer cleaning is performed. By contrast, in a case in which the process cartridge 1 is not installed in the main body 100, the time to perform the secondary transfer cleaning is not extended, and the secondary transfer cleaning is performed for the predetermined time period preset as the default instructed by the controller.

According to the present illustrative embodiment, in a case in which the process cartridge 1 is installed in the main body 100, the time to perform the secondary transfer cleaning is extended by the controller. With this configuration, even when the toner leakage occurs upon installation of the process cartridge 1 in the main body 100, thus contaminating the intermediate transfer belt 8, the recording medium is prevented from getting contaminated. In a case in which the process cartridge 1 is not installed in the main body 100 upon the startup operation after the printing is completed normally, the time to perform the secondary transfer cleaning is not extended, thereby reducing the first print time.

The time during which the secondary transfer cleaning is performed may be extended always when the process cartridge 1 is detached from and installed in the main body 100. However, the toner hardly leaks from the process cartridge 1 upon installation and detachment thereof if the process cartridge 1 installed in the main body 100 is relatively new. Performing the secondary transfer cleaning in such a case is economically disadvantageous.

Furthermore, the toner leakage is not limited to the process cartridge 1 which has been removed and installed. Because the detachment and the installation of the process cartridge 1 cause vibration of the main body 100, which then causes other process cartridges 1 which have been already installed in the main body 100 to vibrate. As a result, the toner leakage may occur in these process cartridges 1. Thus, determination as to whether the process cartridge 1 is new based only on the process cartridge 1 detached and installed is not sufficient. It is desirable to decide whether other process cartridges 1 are new as well.

Figure 5:
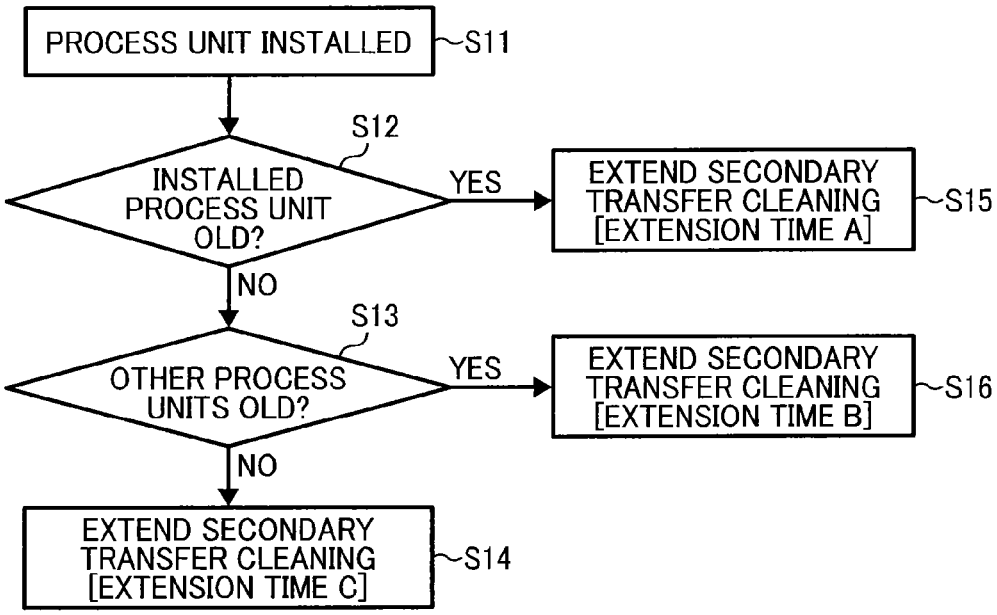
FIG. 5 is a flowchart showing steps of determination of a secondary transfer unit that requires the secondary-transfer cleaning.

In view of the above, an example of the control is described with reference to FIG. 5. FIG. 5 illustrates a flowchart showing steps in a process of determination of the secondary transfer cleaning time according to another illustrative embodiment of the present disclosure.

First, after installation of the process cartridge 1 is recognized at step S11, whether this currently-installed process cartridge 1 in the main body 100 is old is determined by the controller at step S12. If the currently-installed process cartridge 1 is old (YES at step S12), an extension time A is selected at step S15 and the secondary transfer cleaning is performed.

If the currently-installed process cartridge 1 is new (NO at step S12), the process advances to the next step at which whether other process cartridges 1 which have been installed in the main body 100 are old is determined at step S13. If other process cartridges 1 are old (YES at step S13), an extension time B is selected at step S15 and the secondary transfer cleaning is performed. If other process cartridges 1 are new (NO at step S13), an extension time C is selected at step S14 and the secondary transfer cleaning is performed.

The present inventors have recognized that the toner leakage from the seal member is related to a travel distance of the process cartridge 1. The seal member contacts the end portions of the developing roller 4*b* to prevent toner from leaking therefrom. As the travel distance of the process cartridge 1 increases, the end portions of the developing roller 4*b* get abraded due to contact with the seal member.

It is known that a threshold travel distance at which the toner leakage occurs is equal to or greater than 3000 m. According to the present illustrative embodiment with reference to FIG. 5, when a travel distance L of the subject process cartridge 1 is less than 3000 m (L<3000 m), the process cartridge 1 is considered as new. When the travel distance L is equal to or greater than 3000 m (3000 m≤L), the process cartridge 1 is considered as old. The travel distance of the process cartridge 1 is obtained from the information stored in the storage element 31 such as the IC chip provided to each of the process cartridges 1.

FIG. 6 is a table showing results of evaluation of the contamination of the recording medium due to the toner leakage under different extensions of time to perform the secondary transfer cleaning.

In Embodiment 1 and Embodiment 2 in FIG. 6, the detached-and-installed process cartridge 1 and other process cartridges 1 are new. However, in Embodiment 1, the travel distance L of each of the process cartridges 1 is less than 1000 m (L<1000 m), which is shorter than the travel distance (L<3000 m) of each of the process cartridges in Embodiment 2. In Embodiment 3, the detached-and-installed process cartridge 1 and other process cartridges 1 are old. In Embodiment 4, the detached-and-installed process cartridge 1 is new, and other process cartridges are old.

In Comparative examples 1, 2, and 3, the condition (new or old) of each of the process cartridges is the same as that of Embodiment 3. In Comparative examples 4 and 5, the condition (new or old) of each of the process cartridge 1 is the same as that of Embodiment 4. In Comparative examples 1, 2, and 3, and Embodiment 3, the extension of time t to perform the secondary transfer cleaning is varied. Similarly, in Comparative examples 4 and 5, and Embodiment 4, the extension of time t to perform the secondary transfer cleaning is varied.

The results of evaluation shown in FIG. 6 indicate the following.

a) When the detached-and-installed process cartridge 1 and other process cartridges 1 are new such as in Embodiment 1 and 2, the recording medium is not contaminated even when the extension of time for the secondary transfer cleaning is zero (0).

b) When the detached-and-installed process cartridge 1 and other process cartridges 1 are old such as in Comparative examples 1, 2, and 3, and Embodiment 3, it is necessary to extend the time to perform the secondary transfer cleaning by 15 seconds or more in order to prevent contamination of the recording medium completely.

c) When the detached-and-installed process cartridge 1 is new and other process cartridges 1 are old such as in Comparative examples 4 and 5, and Embodiment 4, it is necessary to extend the time to perform the secondary transfer cleaning by 10 seconds or more in order to prevent contamination of the recording medium completely.

d) When the detached-and-installed process cartridge 1 and other process cartridges 1 are old, it is necessary to extend the time to perform the secondary transfer cleaning even longer than the case in which the detached-and-installed process cartridge 1 is new and other process cartridges 1 are old.

e) Even when the time to perform the secondary transfer cleaning is extended by five seconds, contamination of the recording medium is not prevented although the degree by which the recording medium is contaminated differs (Comparative examples 1 through 5, and Embodiment 3 and 4).

In the image forming apparatus used in the evaluation, a distance between the primary transfer nip of the process cartridge 1Y at the extreme upstream end and the secondary transfer nip is approximately 750 mm, and the linear velocity of the intermediate transfer belt 8 is approximately 150 mm/sec. In this case, it takes approximately five (5) seconds for the intermediate transfer belt to arrive at the secondary transfer nip from the primary transfer nip of the process cartridge 1Y. As can be understood from the above fact and the case of e), the recording medium is contaminated while the toner dropped onto the intermediate transfer belt 8 from the process cartridge 1Y at the extreme upstream end stays in the secondary transfer nip. In order to prevent the contamination completely, the secondary transfer cleaning needs to be performed at least until the toner on the intermediate transfer belt 8 passes through the secondary transfer nip.

In view of the above, in addition to the standard control, at least one of the following control or a combination of the control is performed preferably.

Cleaning of the secondary transfer roller 12 after the process cartridge 1 is installed is performed until at least the portion of the intermediate transfer belt 8 that formed the primary transfer nip with the process cartridge 1Y passes through the secondary transfer nip. This means that the following relation is satisfied: $T2>X/V$, where X [mm] is a circumference distance of the intermediate transfer belt 8, and V [m/sec] is the belt linear velocity (Equation 1).

In order to shorten the first print time, the secondary transfer cleaning which is set as the default associated with the startup operation after printing is completed normally is completed before the portion of the intermediate transfer belt 8 which formed the primary transfer nip arrives at the secondary transfer nip.

Depending on the color of toner, contamination may or may not be visible. For example, even when the leakage of toner occurs in the process cartridge 1Y of yellow, contamination on the recording medium is difficult to be seen. Equation 1 can be based on the process cartridge of the color which stands out on the recording medium, for example, black color, when the recording medium is contaminated. In other words, the secondary transfer roller 12 is cleaned after installation of the process cartridge 1 until the portion of the intermediate transfer belt 8 that formed the primary transfer nip with the process cartridge 1Bk for black passes through the secondary transfer nip.

Whether the time to perform the secondary transfer cleaning is extended is determined based on the travel distance of the process cartridge 1 installed in the main body 100.

In a configuration in which a plurality of process cartridges 1 is detachably attachable relative to the main body 100, the extension of time to perform the secondary transfer cleaning is determined in accordance with the travel distance of one of the plurality of process cartridges which is installed in the main body 100 and other process cartridges 1 after one of the plurality of process cartridges is installed in the main body 100.

When the process cartridge 1 installed in the main body 100 and other process cartridges 1 are new, the extension of time to perform the secondary transfer cleaning is set to zero (0).

In a case in which the time to perform the secondary transfer cleaning is extended in the cleaning device 30, the voltage supplied to the secondary transfer roller 12 can be of the same polarity as that of the charged toner between the predetermined time T1 set as the default and the extended cleaning time t. (For example, when the polarity of charged toner is negative, the applied voltage by the cleaning device 30 is negative.)

Figure 7:
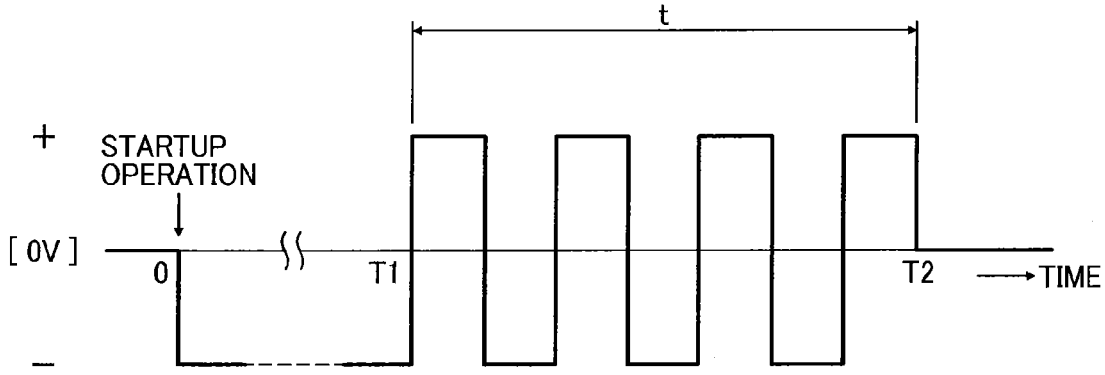
FIG. 7 is a schematic diagram illustrating changes in a polarity of voltage supplied to the secondary transfer roller.

Alternatively, as illustrated in FIG. 7, during the extended cleaning time t, the polarity of voltage supplied to the secondary transfer roller 12 may be inverted alternately. That is, when the process cartridge 1 is installed in the main body 100, the voltage having the same polarity as that of the charged toner is supplied to the secondary transfer roller 12 during the predetermined time T1. Subsequently, the cleaning device 30 is controlled such that the voltage having the same polarity as that of the charged toner and the voltage having the polarity opposite that of the charged toner are alternately supplied to the secondary transfer roller 12.

Generally, toner particles in the toner include not only toner particles having the target charge polarity, but also a small amount of toner particles having an opposite polarity. By inverting the polarity of the voltage as described above, the toner particles having the opposite polarity to the target polarity can be reliably removed from the surface of the secondary transfer roller 12. Preferably, the inversion of the polarity of the voltage is performed continuously at least until the secondary transfer roller 12 completes one rotation.

According to the present illustrative embodiment, the cleaning device 30 supplies a voltage to the secondary transfer roller 12. Alternatively, the cleaning device 30 may supply a voltage to the drive roller 9 disposed opposite the secondary transfer roller 12 via the intermediate transfer belt 8. In this case, the drive roller 9 is supplied with a voltage having a polarity opposite that of the charged toner.

Figure 8:
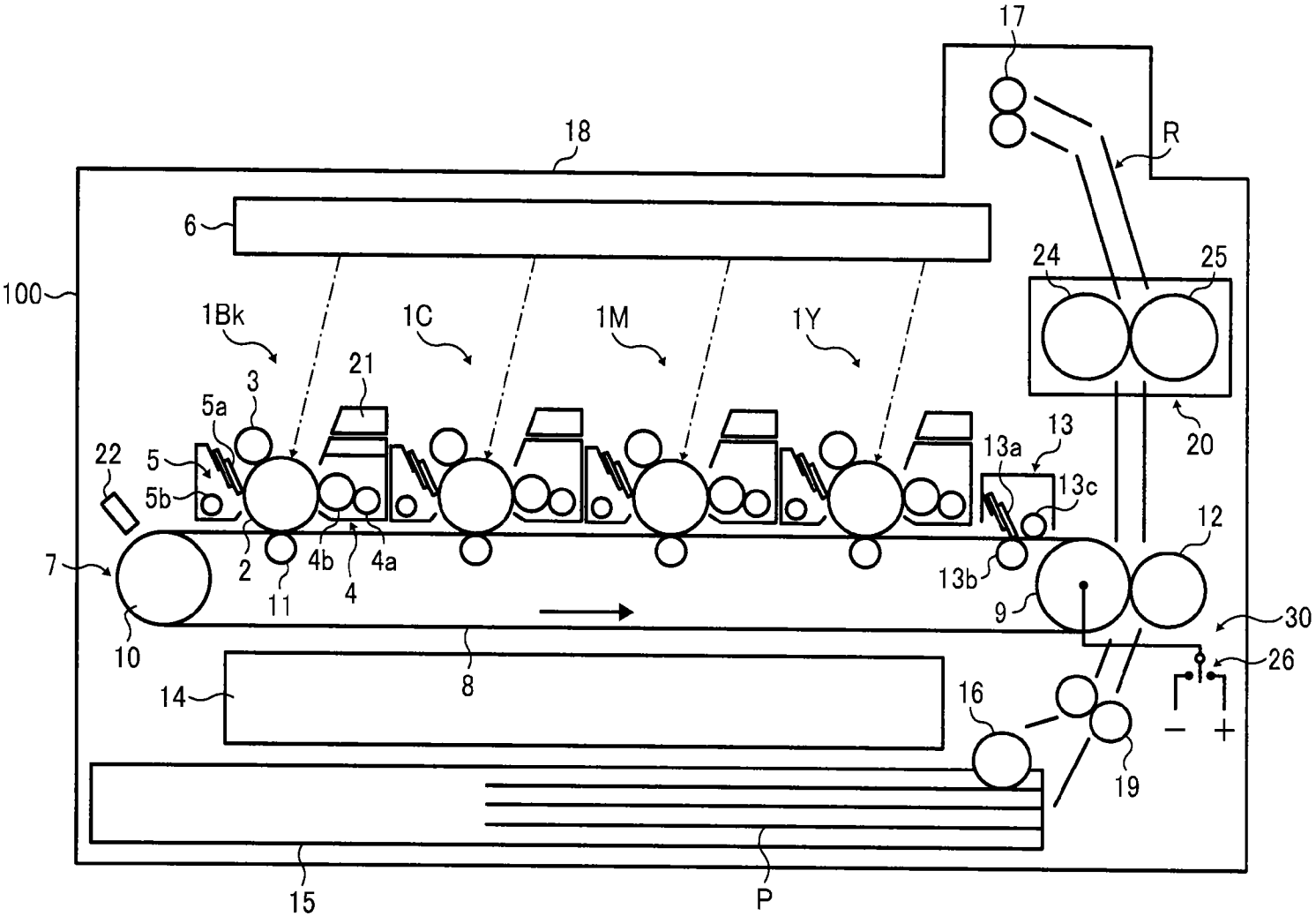
FIG. 8 is a schematic diagram illustrating an image forming apparatus according to another illustrative embodiment of the present disclosure.

With reference to FIG. 8, a description is provided of supplying a voltage to the drive roller 9 according to another illustrative embodiment. In the configuration shown in FIG. 8, during the predetermined time T1 set as a default time and the extended cleaning time t in the secondary transfer cleaning, the drive roller 9 is supplied with a voltage having the polarity opposite that of the charged toner. For example, in a case in which the polarity of charged toner is negative, the polarity of the applied voltage is positive. However, it is to be noted that the polarity of charged toner is not limited to negative, and a suitable polarity is selected depending on the device.

Furthermore, similar to the configuration shown in FIG. 7, the polarity of the voltage in the extended cleaning time t may be inverted alternately. In other words, when the process cartridge 1 is installed in the main body 100, the cleaning device 30 is controlled such that after the drive roller 9 is supplied with a voltage having the polarity opposite that of the charged toner for the predetermined time period T1, the drive roller 9 is supplied alternately with a voltage having the same polarity as that of the charged toner and a voltage having the opposite polarity to the polarity of charged toner.

According to the present illustrative embodiment, a description was provided of the image forming apparatus in which the process cartridge 1 is detachably attachable relative to the main body 100. The present disclosure can be applied to known image forming apparatuses in which the process cartridge includes a toner supply unit 21 as a single integrated unit (known as an all-in-one type or AIO type) and the process cartridge is detachably attachable relative to the main body.

Alternatively, the present disclosure may be applied to a configuration in which the developing unit including the developing device is detachably attachable relative to the main body. Still alternatively, the present disclosure may be applied to a configuration in which the photosensitive member, the charging roller, and the cleaning device for cleaning the photosensitive member constitute a single integrated unit detachably attachable relative to the main body.

The present disclosure may be applied to any of the above image forming apparatuses. That is, the present disclosure can be applied to an assembly having at least one of the photosensitive member 2 and the developing device 4, and the assembly is detachably attachable relative to the main body 100.

According to the present illustrative embodiments described above, the secondary transfer member 12 is a roller. Alternatively, the secondary transfer member may employ a belt-type (secondary transfer belt).

According to the present illustrative embodiments described above, the plurality of photosensitive members 2 is disposed above the intermediate transfer belt 8 and faces the upper surface of the intermediate transfer belt 8. Alternatively, the plurality of photosensitive members 2 may be disposed below the intermediate transfer belt 8 and face the bottom surface of the intermediate transfer belt 8. With this configuration, even when the toner leakage occurs upon installation of the process cartridge 1 in the main body 100, thus contaminating the intermediate transfer belt 8, the recording medium is prevented from getting contaminated.

In an aspect of the present disclosure, an image forming apparatus includes: an image bearing member to bear a latent image on a surface thereof; a developing device to supply toner to the image bearing member to develop the latent image into a toner image; an intermediate transfer member disposed opposite the image bearing member to form a primary transfer nip therebetween to transfer primarily the toner image borne on the image bearing member onto the intermediate transfer member; a secondary transfer member disposed opposite the intermediate transfer member to form a secondary transfer nip therebetween to transfer secondarily the toner image borne on the intermediate transfer member onto a recording medium; a cleaning device to clean the secondary transfer member for a predetermined time period T1 during a startup operation after printing is completed normally before subsequent printing; and a main body to house the image bearing member, the developing device, the intermediate transfer member, the secondary transfer member, and the cleaning device At least one of the image bearing member and the developing device constitutes a process cartridge detachably attachable relative to the main body, and in a case in which the process cartridge is installed in the main body, the cleaning device cleans the secondary transfer member for a time period T2 extended from the predetermined time period T1.

In the image forming apparatus, the cleaning device supplies the secondary transfer member with a first voltage having a same polarity as that of toner.

In the image forming apparatus, the cleaning device cleans the secondary transfer member for the predetermined time period T1 and completes the cleaning before a first portion of the intermediate transfer member that has constituted the primary transfer nip with the image bearing member arrives at the secondary transfer nip. After the process cartridge is installed in the main body, the cleaning device cleans the secondary transfer member until at least the first portion of the intermediate transfer member passes through the secondary transfer nip.

In an aspect of the present disclosure, the image forming apparatus further includes an opposing member disposed facing the secondary transfer member via the intermediate transfer member at the secondary transfer nip, and the cleaning device supplies the opposing member with a second voltage having a polarity opposite that of toner.

In the image forming apparatus, as the cleaning device cleans the secondary transfer member for the predetermined time period T1, the cleaning device supplies the secondary transfer member with a first voltage having a same polarity as that of toner. As the process cartridge is installed in the main body, the cleaning device supplies alternately the first voltage and a second voltage having a polarity opposite the polarity of toner to the secondary transfer member after the cleaning device supplies the secondary transfer member with the first voltage for the predetermined time period T1.

In an aspect of the present disclosure, the image forming apparatus further includes an opposing member disposed facing the secondary transfer member via the intermediate transfer member at the secondary transfer nip. As the cleaning device cleans the secondary transfer member for the predetermined time period T1 the cleaning device supplies the opposing member with a second voltage having a polarity opposite that of toner. As the process cartridge is installed in the main body, the cleaning device supplies alternately a first voltage having a same polarity as that of toner and the second voltage to the opposing member after the cleaning device supplies the opposing member with the second voltage for the predetermined time period T1.

In the image forming apparatus, the process cartridge includes a storage element to store information, and installation of the process cartridge in the main body is recognized by reading the information stored in the storage element.

In an aspect of the present disclosure, the image forming apparatus further includes an intermediate transfer member cleaning device to clean toner adhered to the intermediate transfer member, and the intermediate transfer member cleaning device is disposed upstream from the primary transfer nip and downstream from the secondary transfer nip.

In the image forming apparatus, based on a travel distance of the process cartridge installed in the main body, whether the cleaning needs to be extended is determined.

In an aspect of the present disclosure, the image forming apparatus further includes a plurality of process cartridges detachably attachable relative to the main body. In a case in which one of the process cartridges is installed in the main body, a length of extension of time from the predetermined time T1 is determined based on a travel distance of the installed process cartridge and other process cartridges.

In the image forming apparatus in a case in which the installed process cartridge and other process cartridges are relatively new, the length of extension of time is zero.

In the image forming apparatus, the secondary transfer member contacts always the intermediate transfer member.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus comprising:

an image bearing member to bear a latent image on a surface thereof;

a developing device to supply toner to the image bearing member to develop the latent image into a toner image;

an intermediate transfer member disposed opposite the image bearing member to form a primary transfer nip therebetween to transfer primarily the toner image borne on the image bearing member onto the intermediate transfer member;

a secondary transfer member disposed opposite the intermediate transfer member to form a secondary transfer nip therebetween to transfer secondarily the toner image borne on the intermediate transfer member onto a recording medium;

a cleaning device to clean the secondary transfer member for a predetermined time period T1 during a startup operation after printing is completed normally before subsequent printing; and a main body to house the image bearing member, the developing device, the intermediate transfer member, the secondary transfer member, and the cleaning device, wherein at least one of the image bearing member and the developing device constitutes a process cartridge detachably attachable relative to the main body, and in a case in which the process cartridge is detached from and installed in the main body, the cleaning device cleans the secondary transfer member for a time period T2 extended from the predetermined time period T1 after installation of the process cartridge is completed.

2. The image forming apparatus according to claim 1, wherein the cleaning device supplies the secondary transfer member with a first voltage having a same polarity as that of toner.

3. The image forming apparatus according to claim 2, wherein the cleaning device cleans the secondary transfer member for the predetermined time period T1 and completes the cleaning for the predetermined time period T1 before a first portion of the intermediate transfer member that has constituted the primary transfer nip with the image bearing member arrives at the secondary transfer nip, and wherein after the process cartridge is installed in the main body the cleaning device cleans the secondary transfer member for the time period T2 and does not complete the cleaning of time period T2 until at least the first portion of the intermediate transfer member passes through the secondary transfer nip.

4. The image forming apparatus according to claim 1, wherein the process cartridge includes a storage element to store information, and installation of the process cartridge in the main body is recognized by reading the information stored in the storage element.

5. The image forming apparatus according to claim 1, further comprising an intermediate transfer member cleaning device to clean toner adhered to the intermediate transfer member, and the intermediate transfer member cleaning device is disposed upstream from the primary transfer nip and downstream from the secondary transfer nip.

6. The image forming apparatus according to claim 1, further comprising a plurality of process cartridges detachably attachable relative to the main body, wherein in a case in which one of the process cartridges is installed in the main body, a length of extension of time from the predetermined time T1 is determined based on a travel distance of the installed process cartridge and other process cartridges.

7. The image forming apparatus according to claim 1, wherein the secondary transfer member contacts always the intermediate transfer member.

8. An image forming apparatus comprising:

an image bearing member to bear a latent image on a surface thereof;

a developing device to supply toner to the image bearing member to develop the latent image into a toner image;

an intermediate transfer member disposed opposite the image bearing member to form a primary transfer nip therebetween to transfer primarily the toner image borne on the image bearing member onto the intermediate transfer member;

a secondary transfer member disposed opposite the intermediate transfer member to form a secondary transfer nip therebetween to transfer secondarily the toner image borne on the intermediate transfer member onto a recording medium;

a cleaning device to clean the secondary transfer member for a predetermined time period T1 during a startup operation after printing is completed normally before subsequent printing; and a main body to house the image bearing member, the developing device, the intermediate transfer member, the secondary transfer member, and the cleaning device, wherein at least one of the image bearing member and the developing device constitutes a process cartridge detachably attachable relative to the main body, and in a case in which the process cartridge is detached from and installed in the main body, whether a cleaning predetermined time period T1 needs to be extended for a time period T2 is determined based on a travel distance of the process cartridge installed in the main body.

9. The image forming apparatus according to claim 8, wherein the installed process cartridge has a travel distance less than or equal to a predetermined distance, the predetermined time period T1 is not extended by a time period T2.

* * * * *